US006719166B2

(12) United States Patent
Ceolin et al.

(10) Patent No.: US 6,719,166 B2
(45) Date of Patent: Apr. 13, 2004

(54) HERMETIC CLOSURE SYSTEM BETWEEN A COVER AND A PACKAGE

(76) Inventors: Armando Ceolin, Rua Camargo Pimentel, 191 Jardim Guanabara, 13073-340 Campinas-SP (BR); Benjamín Arturo Moyano, Rua Francisco Pereira dos Santos, 53 Pq São Domingos, 05121-020 São Paulo-SP (BR)

( * ) Notice: Subject to any disclaimer, the term of this patent is extended or adjusted under 35 U.S.C. 154(b) by 0 days.

(21) Appl. No.: 10/060,787

(22) Filed: Jan. 30, 2002

(65) Prior Publication Data

US 2003/0141311 A1 Jul. 31, 2003

(51) Int. Cl.[7] ..... B65D 41/16; B65D 43/10

(52) U.S. Cl. ..... 220/783; 220/784; 220/787; 220/788; 220/790; 220/794; 220/780; 220/798

(58) Field of Search ..... 220/780, 783, 220/784, 787, 788, 790, 794, 796, 797, 798

(56) References Cited

U.S. PATENT DOCUMENTS 1,847,245 A * 3/1932 Hothersall ..... 220/319
2,775,362 A * 12/1956 Henchert ..... 220/798
3,420,397 A * 1/1969 Miller ..... 220/203.09
4,421,247 A * 12/1983 Lombardo et al. ..... 220/798
4,442,952 A * 4/1984 Patarini ..... 220/798
4,524,882 A * 6/1985 Buc ..... 220/783
5,125,530 A * 6/1992 Straub ..... 220/783
5,261,551 A * 11/1993 Watt ..... 220/319
6,168,044 B1 * 1/2001 Zettle et al. ..... 220/784
6,588,618 B1 * 7/2003 Davis ..... 220/254.7

* cited by examiner

*Primary Examiner*—Stephen K. Cronin
*Assistant Examiner*—James Smalley
(74) *Attorney, Agent, or Firm*—Alston & Bird LLP

(57) ABSTRACT

A closure system for a package includes a cover that interacts with a receiving ring. The cover has a main face and a first protuberance of U-shaped cross-section that projects substantially perpendicular to a plane of the main face and extends about the perimeter of the cover. The first protuberance has at least one first lock element in the form of a projection. The receiving ring is formed on the package and has a second U-shaped protuberance that projects substantially parallel to the package axis and extends about the perimeter of the ring. The second protuberance has a second lock element in the form of a projection. The second protuberance of the ring is configured to receive the first protuberance of the cover such that the first and second lock elements engage each other and prevent removal of the cover while so engaged.

11 Claims, 6 Drawing Sheets

HERMETIC CLOSURE SYSTEM BETWEEN A COVER AND A PACKAGE

FIELD OF THE INVENTION

The present invention relates to a hermetic closure system for packages, such as metal cans, drums, or the like, used in storing industrial and/or sanitary products.

BACKGROUND OF THE INVENTION

With present-day techniques, conventional systems for closing packages do not offer guarantees that, once the product has been enclosed within a package, the package will remain closed during storage, transportation, and distribution until the moment at which the product is used by the final consumer.

One known double-closure system is composed of a cover having a protuberance that extends along its whole perimeter and preferably has a substantially U-shaped lower portion. The protuberance of the cover mates with a receiving ring on the package. The receiving ring has a second protuberance of great depth, which is also substantially U-shaped and extends along the whole perimeter of the ring. However, this configuration still permits leakage of the product, especially if it is a low-viscosity liquid. The processes of manufacturing this system aim at obtaining a cover and a ring with very small size tolerances, so that the closure between them takes place as uniformly as possibly, in order to eliminate any small region where there is no contact between the cover and the ring, this region being potentially liable to leakage.

But the problem of inadequate sealing of a package is a result of the effect of colloidal pressures from the internal mass present therein. These pressures originate in the interior of the package, usually due to the movements which the package undergoes during its transport. They may also be caused by the formation of gaseous masses by the product that is contained. In both cases, the pressure exerted within the package results in force components perpendicular to the surface of the container, acting to separate the cover from the package, since the engagement is maintained only by the contact friction between the two components.

Depending upon the kind of product packed, a protecting film is sometimes applied onto the inner surface of the cover that will engage the package. In this case, however, the friction is drastically reduced as a result of the protective film, which facilitates the opening of the cover by action of the internal pressures and, as a result, increases the lack of security presented by this closure system.

In an attempt at eliminating these drawbacks, the area of contact between the cover and the ring has been enlarged, which increases the friction and, as a result, the security of the closure system. The points of contact for increasing the resistance or friction between these components have also been enlarged. However, both these solutions make the end product considerably more expensive because of the increase in consumption of raw material as well as the need for tight controls on the manufacturing process.

SUMMARY OF THE INVENTION

The objective of the present invention is to provide a hermetic closure system on packages, preferably metallic ones, used for packing industrial and/or sanitary products, by means of a double closure combined with a mechanical locking, enabling one to handle the package in any transport and storage conditions and eliminating the possibility of the cover inadvertently opening. However, the cover may be opened, closed and reopened whenever necessary, without impairing the sealing.

The hermetic closure system includes a cover and a receiving ring provided on the package. The cover is provided with a first protuberance that extends substantially perpendicular to the plane of the main face of the cover and is arranged substantially along the whole perimeter of the cover, the first protuberance comprising at least one wall and at least one first lock element in the form of a projection. The receiving ring is located at a first main end of the package and comprises a second protuberance substantially perpendicular to the plane of the main face of the ring and arranged substantially along the whole perimeter of the ring, the second protuberance comprising at least one wall and at least one second lock element in the form of a projection. The second protuberance of the ring is adapted to receive the first protuberance of the cover by engagement, such that the first lock element and the second lock element are engaged with each other.

In a package in accordance with the invention, the tolerances on the dimensions of the cooperatively engaging peripheral surfaces of the cover and the ring may be greater, since the engagement between the lock elements provides a total guarantee of hermetic closure. In this way, virtually all the components mentioned in the specification become utilizable. Greater tolerance in turn means that one may use a manufacturing process with increase in the standard deviation, bringing about a consequent reduction in the production cost of the hermetic closure system. Furthermore, the reduction in manufacture costs does not result in loss of quality of the system, since the hermetic closure continues to be effected with total reliability. In addition, to initiate the manufacture of this hermetic closure system, the manufacturer may carry out minor changes in the stampers already used in the manufacture of similar components.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

Figure 1:
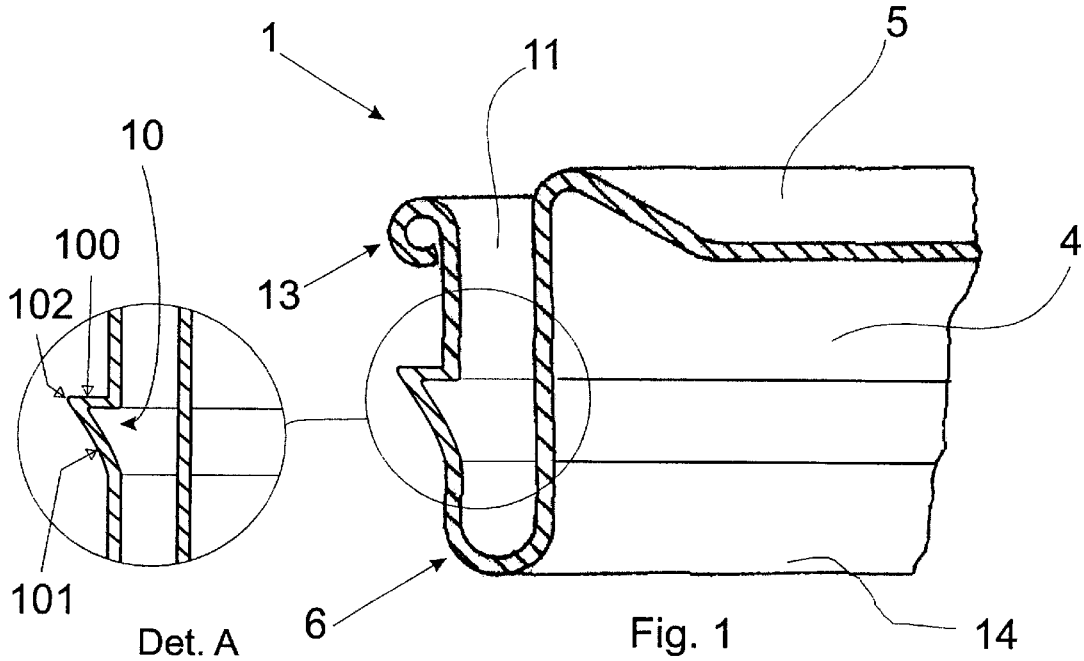
FIG. 1 is a partial front section view of the cover of a first preferred embodiment of the hermetic closure system of the present invention.
Figure 2:
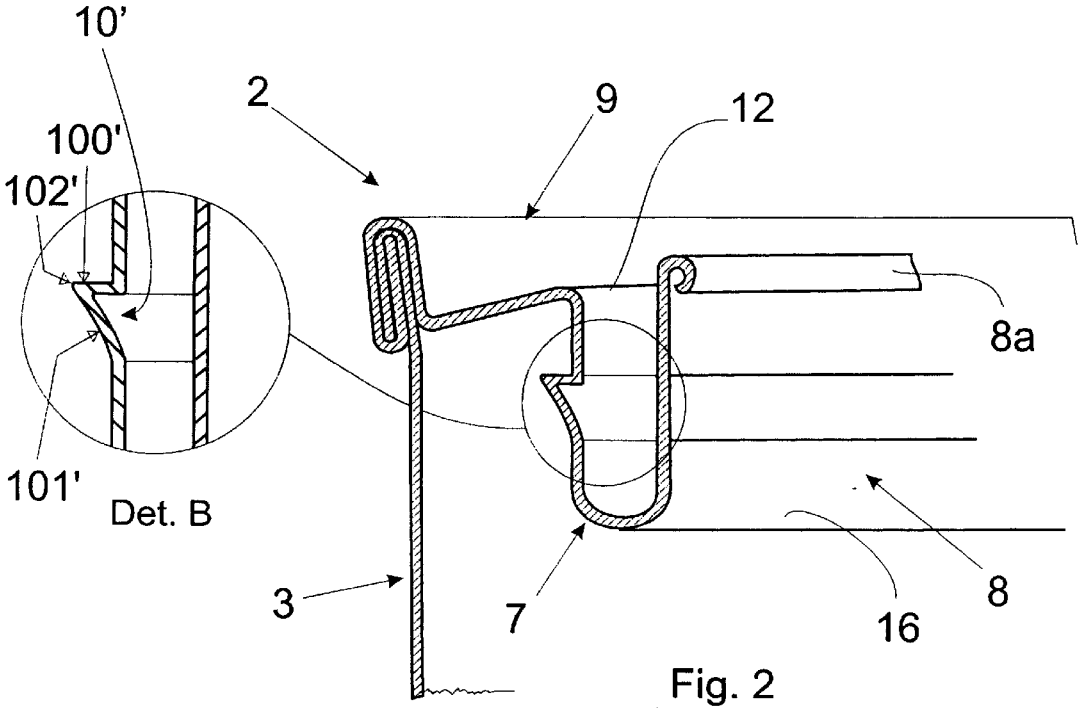
FIG. 2 is a partial front section view of the receiving ring of the first preferred embodiment of the hermetic closure system of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

According to a first preferred embodiment and as can be seen in FIGS. 1 to 9, the sealing or hermetic closure system 15 of the present invention comprises a cover 1, preferably metallic and cylindrical, provided with a base (not shown), a flap portion 5 and a first open protuberance 6 substantially perpendicular to the plane of the main face of the cover 1, arranged substantially along the whole perimeter of the cover 1. The first protuberance 6 preferably has a substantially U-shaped profile. The protuberance 6 is formed from a first wall 11 and a second wall 4, which are substantially parallel to each other and are joined at first or lower ends thereof by a substantially semicylindrical end portion 14. The distance between the walls 11 and 4 is substantially constant over virtually the whole height of the first protuberance 6, but is preferably slightly smaller in the region adjacent the semicylindrical end portion 14, such that the second wall converges toward the first one (difference in radii of curvature). The wall 11 has a ring-shaped second or upper end 13, substantially opposed to the substantially semicylindrical end portion 14 of the first protuberance 6. The ring-shaped second end 13 has a substantially cylindrical cross-section of small dimensions. The flap portion 5 is located at a second or upper end of the wall 4, substantially opposed to the substantially semicylindrical end portion 14 of the first protuberance 6, and has a substantially circular crown shape, preferably presenting a slight inclination with respect to the main plane of the base of the cover 1. The flap portion 5 imparts structural rigidity to the cover 1. Alternatively, the semicylindrical end portion 14 may have other shapes, as for example, semiparabolic, or comprise various different radii of curvature, with the most closed radius adjacent to the wall 11, in order to facilitate the removal of the cover from the ring.

The first protuberance 6 preferably has one first lock element in the form of a projection 10, but there may be two or more such projections. When there are two projections, they are substantially parallel to each other and located respectively on the first and second walls 11, 1, the direction of the longitudinal length of the projections 10 being substantially perpendicular to the direction of the height of the protuberance 6. Preferably, but not necessarily, the projections 10 extend over the whole circumferential length of the protuberance 6. In the preferred embodiment described here, the projection 10 is located on the first wall 11 but may also be located on the second wall 4.

The cover 1 is fitted into a receiving ring 2, which is preferably metallic and ring-shaped. The receiving ring 2 is provided on the package at the open end thereof, and encircles an axis of the package. The receiving ring has a second open protuberance 7 substantially perpendicular to the plane of the main face of the ring 2 (i.e., the protuberance 7 extends in a direction generally parallel to the axis of the package) and arranged substantially along the whole perimeter of the ring 2. The second protuberance 7 has a substantially U-shaped profile. The protuberance 7 is formed from a third wall 12 and a fourth wall 8, which are substantially parallel to each other and joined at their first or lower ends by a substantially semicylindrical end portion 16. The distance between the walls 12 and 8 is substantially constant over the whole height of the second protuberance 7. The wall 8 has a second or upper end 8*a*, substantially opposed to the substantially semicylindrical end portion 16 of the second protuberance 7; the second end 8*a* has a substantially cylindrical cross-section of small dimensions and faces the interior of the package. The end 8*a* is substantially ring-shaped.

The second protuberance 7 preferably has one second lock element in the form of a projection 10', but there may be two or more such projections. When there are two projections 10', they are substantially parallel to each other and respectively located on the third and fourth walls 12, 8, the direction of the longitudinal length of the projections 10' being substantially perpendicular to the direction of the height of the protuberance 7. Preferably, but not necessarily, the projections 10' extend over the whole length of the protuberance 7. In the preferred embodiment described here, the projection 10' is located on the third wall 12, but it may also be located on the fourth wall 8.

Optionally, both the projections 10 and the projections 10' may be mere segments, without the necessity to extend over the whole circumferential length of the protuberances 6, 7.

In a region 18, substantially opposed to the substantially semicylindrical end portion 16, the third wall 12 assumes a positioning substantially perpendicular to the direction of the height of the protuberance 7. Finally, the portion of the second end 9 of this wall 12 perpendicular to the protuberance 7 is joined to the body 3 of the package at a first end of the body 3.

Regardless of how many first and second projections 10, 10' are employed, they are substantially triangular in shape, defining adjacent upper 100, 100' and lower 101, 101' surfaces, the upper 100, 100' surface being substantially horizontal, thus being perpendicular to the direction of the height of the respective protuberance 6, 7. The free end portion of this upper surface 100, 100' defines a curvature 102, 102', from which the lower surface 101, 101' projects, which is oblique and ends at the wall of the respective protuberance 6, 7. The curvature 102, 102' has this shape in order to avoid the buildup of tensions when the cover 1 and the ring 2 are engaged with each other.

The lower surface 101, 101' preferably is not perfectly straight but rather is a curved surface whose radius of curvature points outwards of the area defined by the cover 1 (i.e., the lower surface is convex in the direction toward the interior of the protuberance 6, 7 in which it is comprised). The upper surface 100, 100' (and by inference the first and second projections 10, 10') projects from the wall of the protuberance outwards thereof, away from the interior of the U-shaped cross-section of the protuberance. This characteristic is not dependent upon the location of the projection, that is, it may be located on the first or second walls 11, 1

(with respect to the first protuberance 6, of the cover 1), or else on the third or fourth walls 12, 8 (with respect to the second protuberance 7, of the ring 2), and in each case the projection extends outward away from the interior of the U-shaped protuberance.

Preferably, the closure system 15 of the present invention comprises a cover 1 and a ring 2 provided with first and second projections 10, 10', respectively located on the first and third walls 11, 12. This is the preferred embodiment, since the tools for making a projection on the first and third walls 11, 12 (i.e., the walls closest to the edge of the cover/ring 1, 2) is simple and easy to manufacture. Another advantage is that the region of the projection 10 of the cover 1 (which is the one to be deformed, as will be explained later), in this case, is in the more easily deformable region of the cover 1 (region of the second end 13 of the first wall 1, which is easier to deform than the region of the flap portion 5 and the second wall 4).

However, other configurations may be conceived, in which the projections 10, 10' are located respectively on the second and fourth walls 4, 8, or even a configuration in which they are located on the two walls of the cover 1 and of the ring 2, when the closure system then comprises two first projections 10 and two second projections 10'. Further, one may envision configurations of the first and second projections other than triangular shape, provided that they are directed outwards of the interiors of the U-shaped protuberances.

Figure 3:
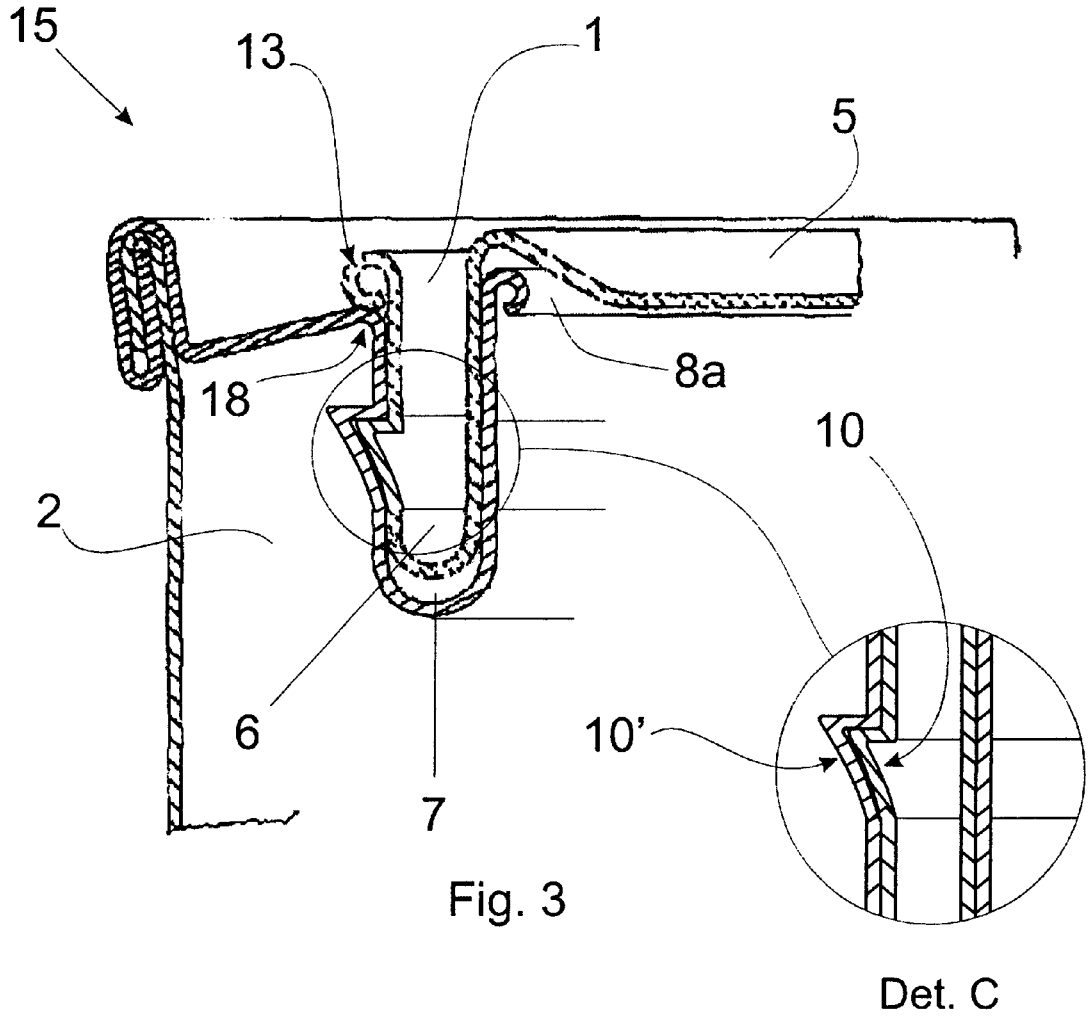
FIG. 3 is a partial front section view of the first preferred embodiment of the hermetic closure system of the present invention when the cover is fixed to the receiving ring.
Figure 4:
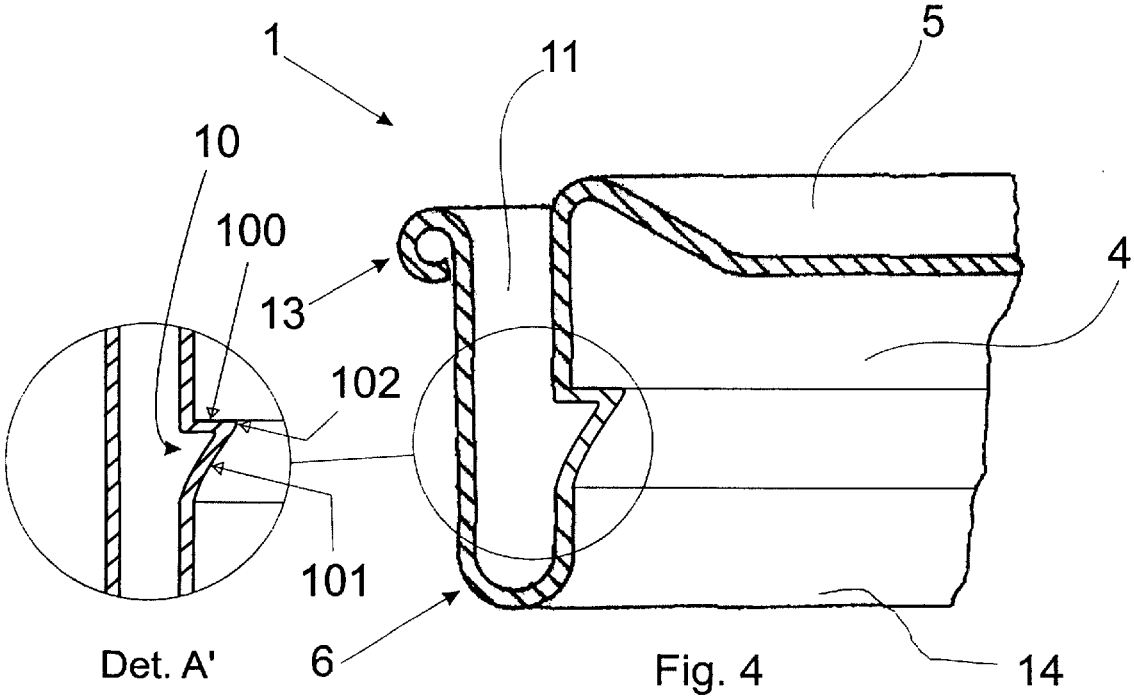
FIG. 4 is a partial front section view of the cover of a second preferred embodiment of the hermetic closure system of the present invention.
Figure 5:
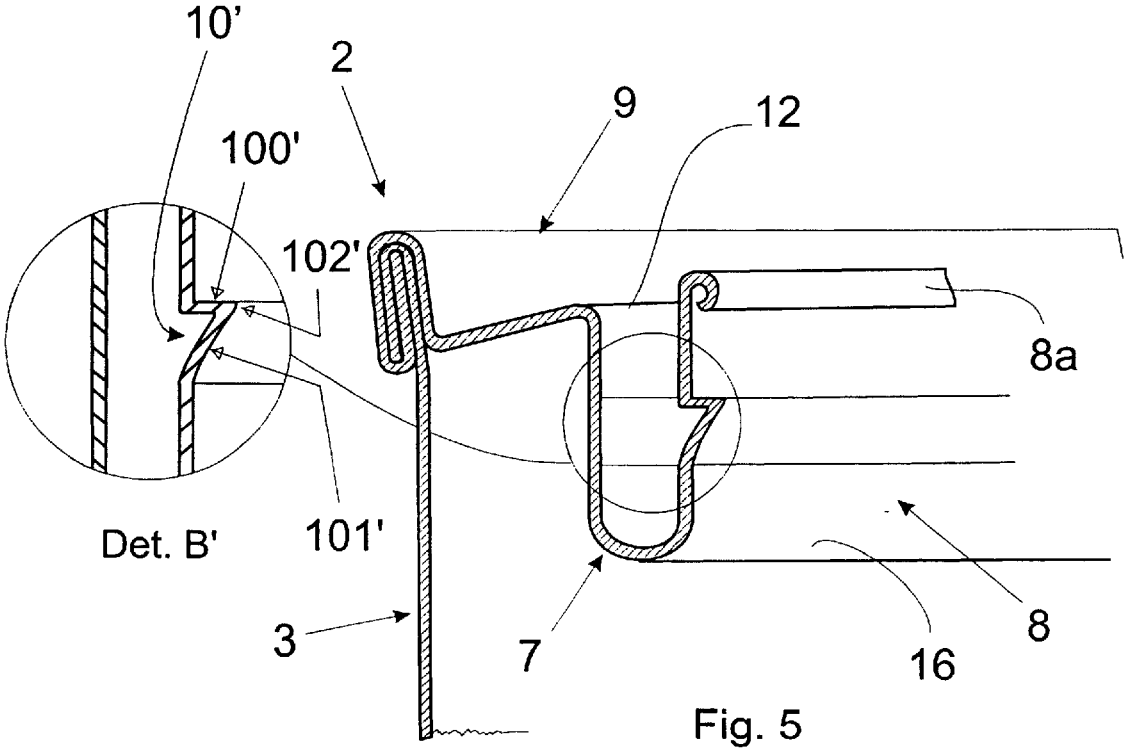
FIG. 5 is a partial front section view of the receiving ring of the second preferred embodiment of the hermetic closure system of the present invention.
Figure 6:
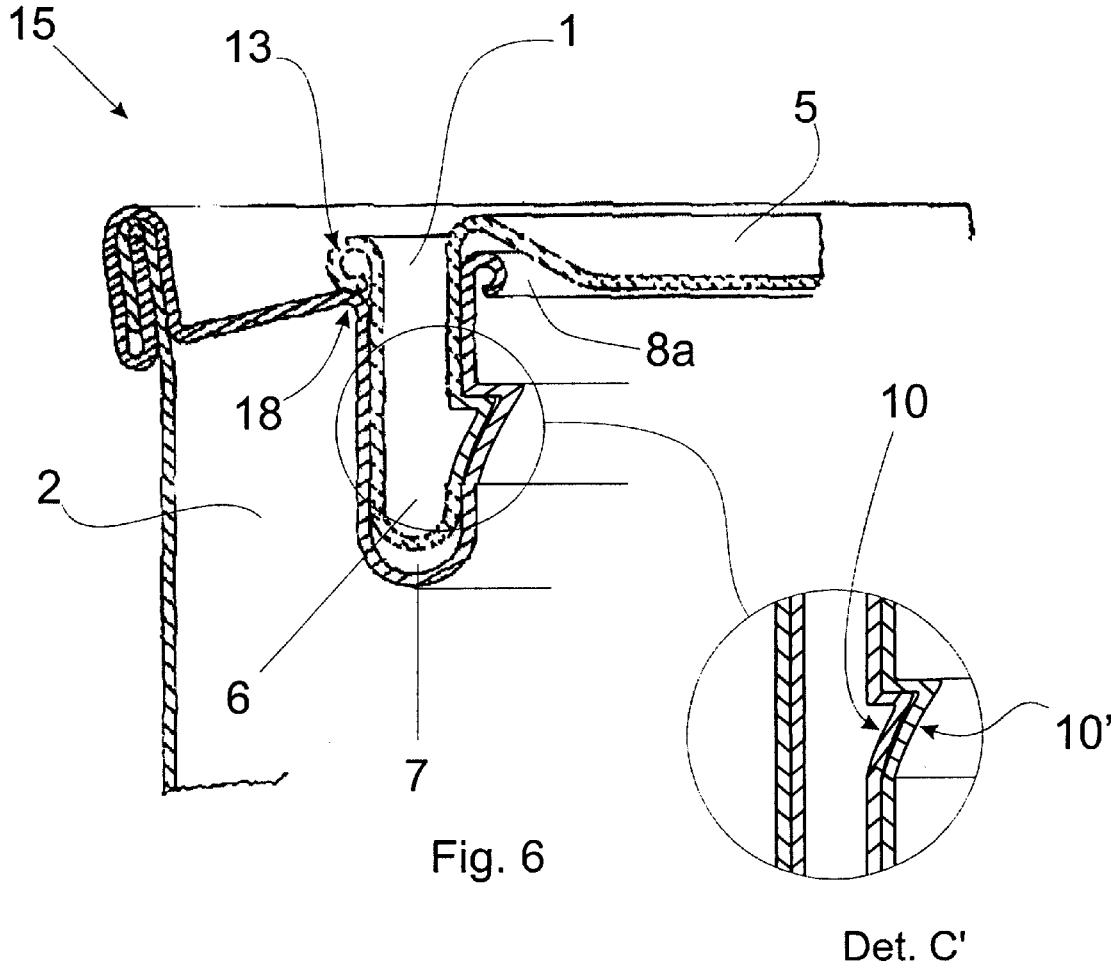
FIG. 6 is a partial front section view of the second preferred embodiment of the hermetic closure system of the present invention when the cover is fixed to the receiving ring.
Figure 7:
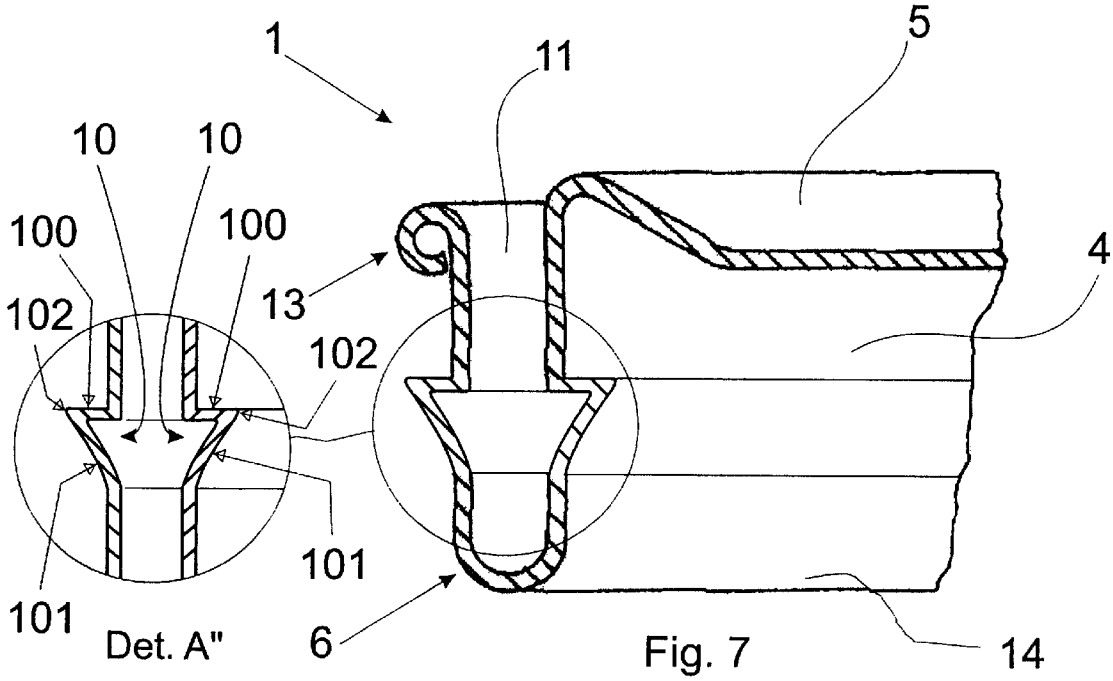
FIG. 7 is a partial front section view of the cover of a third preferred embodiment of the hermetic closure system of the present invention.
Figure 8:
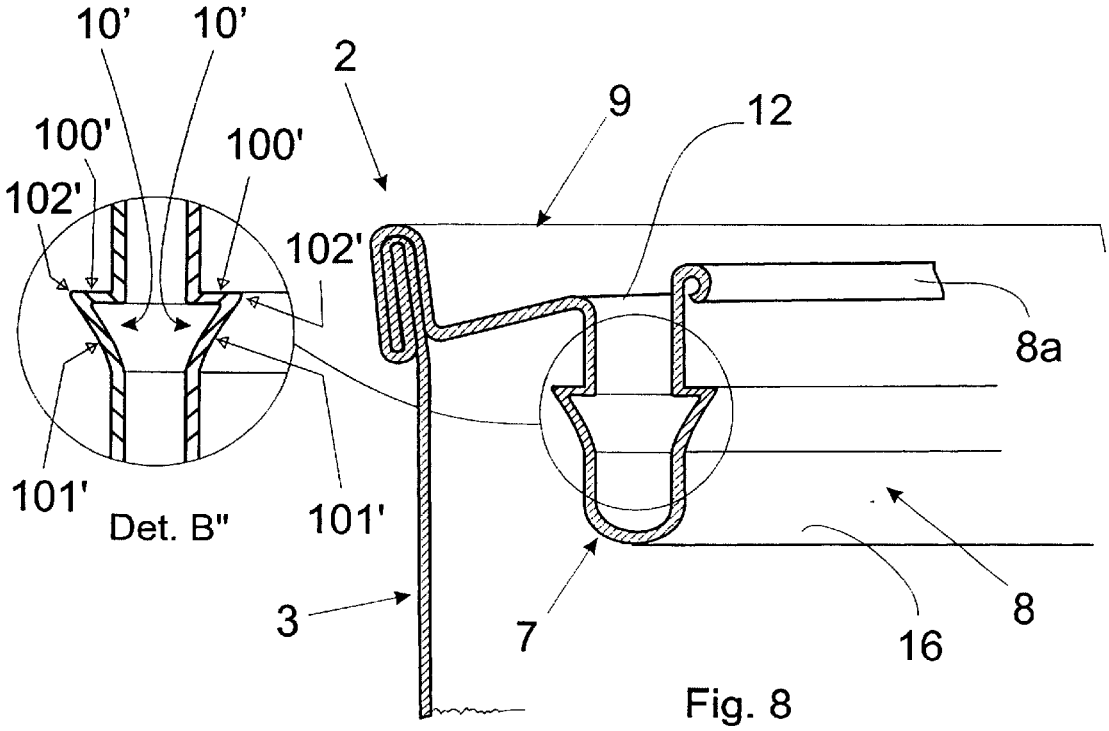
FIG. 8 is a partial front section view of the receiving ring of the third preferred embodiment of the hermetic closure system of the present invention.
Figure 9:
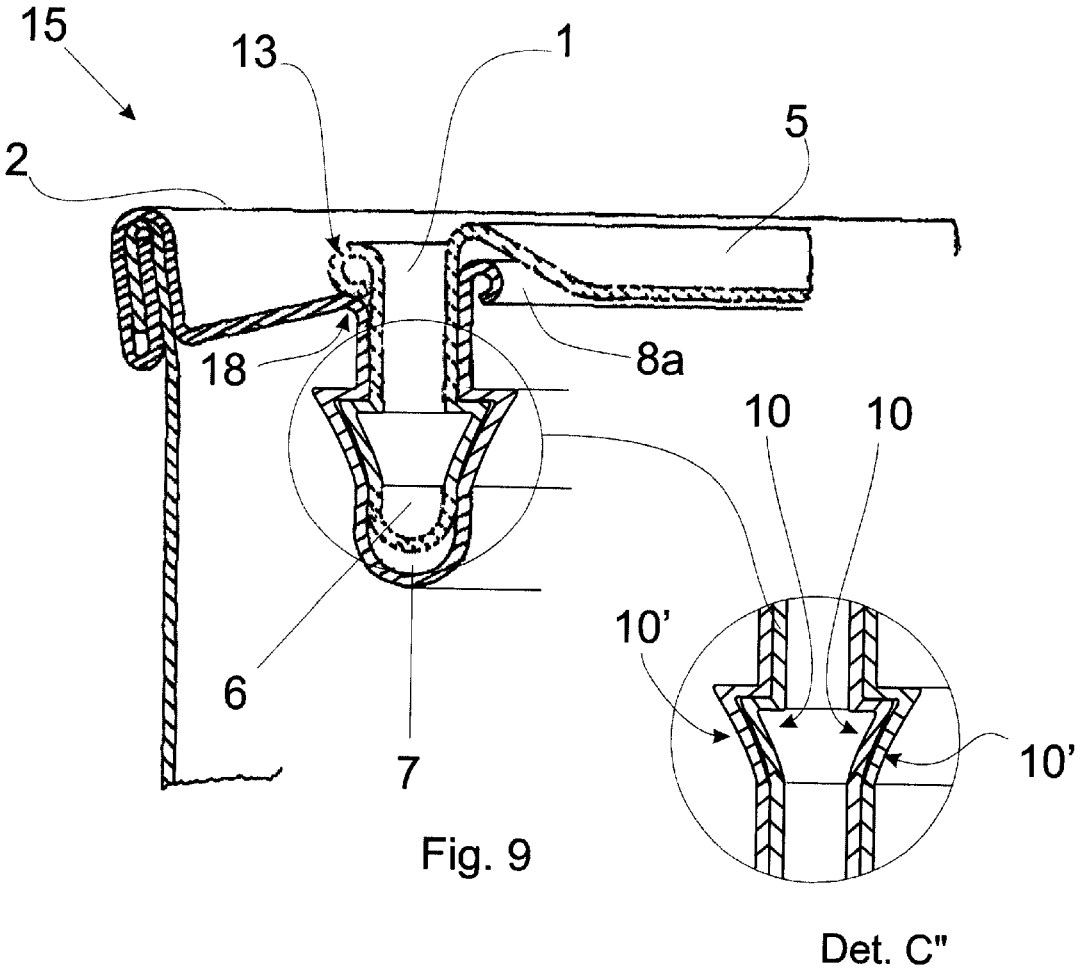
FIG. 9 is a partial front section view of a third preferred embodiment of the hermetic closure system of the present invention when the cover is fixed to the receiving ring.

FIG. 3 illustrates the first preferred embodiment of the hermetic closure 15 in operation, with the cover 1 fitted into the receiving ring 2. The engagement between the two pieces is effected by placing the first protuberance 6 of the cover 1 into the second protuberance 7 of the ring 2.

At a first engagement step, due to the fact that the first protuberance 6 is fractionally smaller than the second protuberance 7, the second protuberance 7 receives the first protuberance 6 with a slight interference, bringing about a male-female type fitting. For this purpose, it is sufficient to press the cover 1 against the ring 2.

At a second closing step, with continued pressing of the cover 1 against the ring 2, the projection 10 on the first protuberance 6 meets the second complementary projection 10' located in the corresponding region of the second protuberance 7, and they fit into each other. It should be noted that, when the two projections 10, 10' are engaged with each other, the first and second end portions 14, 16 preferably do not touch each other, a space remaining between them.

When this engagement is effected, it provides a hermetic sealing of the opening of the package. In order for this second closing step to be carried out, there has to be a horizontal (i.e., radial) movement of the first wall 11 of the cover 1 towards the center of the cover, bringing about the engagement of the first projection 10 into the second projection 10'. This engagement is of a "male-female" type, because the projection 10 of the cover 1 penetrates in the recess formed by interior of the projection 10' of the ring 2. The triangular shape of the first projection 10 works as a wedge forcing a radial movement of the first wall 11.

Once the two lock elements 10, 10' are cooperatively engaged, the only region of contact between the first and second projections 10, 10' is that defined by the upper surface 100 of the first projection 10 with the interior surface of the upper surface 100' of the second projection 10', which in the preferred embodiment are completely horizontal surfaces. The other regions of the first and second projections 10, 10' do not touch each other, thus avoiding a buildup of tensions at points other than that defined above, which could entail permanent deformations of the projections, failures in the fitting between them, or even prevent them from fitting into each other.

In this way, it is not possible to open the package by exerting forces in only the vertical direction (i.e., in the direction of the lengths of the protuberances 6, 7) and, consequently, this closure system is extremely safe. Accidental opening of the package caused by the internal pressure of the liquid, an accidental drop, or other agents thus is highly unlikely.

The opening of the package requires the application of a radial horizontal force, preferably in the region of the second end 13 of the first wall 11 of the cover 1, moving it in a direction toward the interior of the package (i.e., to the right in FIG. 3). This movement causes a radial deformation in the first wall 11 and enables the beginning of the disengagement between the first and second projections. To disengage both projections, it is also necessary to apply a small vertical axial force in this region.

As soon as the curvature 102 of the free end portion of the upper surface 100 of the first projection 10 is no longer prevented from moving vertically "inside-out" of the upper surface 100' of the second projection 10', the wall 11 may return to its rest position and, in this way, (and also due to the slight vertical axial force applied) the cover 1 is rapidly unfitted from the ring 2 along its whole extension, being literally pushed toward disengagement. This operation is accompanied by a characteristic "ploc" noise. Optionally one may configure the cover and ring in such a way that no vertical axial force will be necessary for the disengagement to take place.

This rapid disengagement further prevents remains of product from fixing or clinging to the cover 1 or ring 2, when the package has been opened/closed at least once and a part of the product contained therein has reached the protuberance of the ring 2. This situation is very common with packages that contain paints and varnishes when the user of the product allows a small amount thereof to leak into the protuberance 7 of the ring 2. In these situations, with the packages of the prior art, the cover 1 remains clung to the ring 2, and it is extremely difficult to open it later.

When the semicylindrical end portion 14 assumes other shapes (for example, semiparabolic or comprised of various different radiuses of curvature, with the most closed radius being adjacent to the wall 11), as described before, the removal of the cover is facilitated. This is due to the fact that, when applying the horizontal force and the vertical force to a determined point of the cover 1, it tends to move and opens with an angular movement about a point on the opposite part of the cover 1 (that portion which is fixed to the ring 2 at 180° from the point where the force is applied). Since the most closed radius is adjacent to the wall 11, and the most open radius is adjacent to the second wall 4, when the opening angular movement takes place there is no interference between the end portion and said wall 4, which optimizes the already-mentioned tendency of the cover 1 to "jump" outwards when it is opened.

If the user decides to open the package again by removing the cover 1, the repositioning thereof into the ring 2, when desired, will be effected in a rapid and easy way. It is sufficient for the user to pay attention to the complete closure between the two parts.

Even if a plastic deformation of a certain region of the cover 1 or the ring 2 occurs, such that no friction between the two U shaped protuberances 6, 7 may occur, whereby no self-closure and sealing occur at this place, the locking between the projections 10, 10' goes on perfectly, which brings about the safe and definitive closure of the package, guaranteeing tightness of this locking against leakage of the product.

Concomitantly with the locking of the projections 10, 10', the end 13 of the cover 1 may or may not rest against the region 18 of the third wall 12 of the ring 2.

Evidently, for a person skilled in the art, it is possible to conceive projections 10, 10' of different geometry, as well as to use only one projection, or three or more projections 10, 10' in a hermetic closure system, the choice of a determined geometry and number of projections 10, 10' being a mere configuration option. In addition, one may use covers 1 and rings 2 of shapes other than circular, as for example an elliptical or oval shape, this option also being a mere possibility of configuration.

Figure 10:
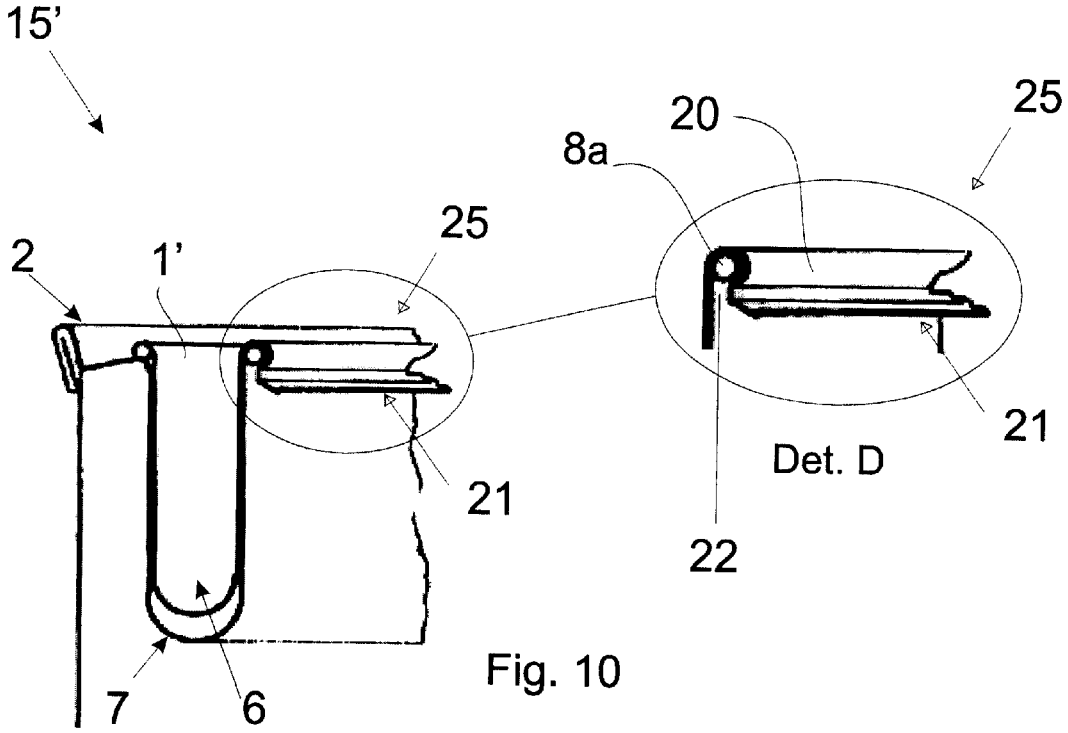
FIG. 10 is a schematic view of a fourth preferred embodiment of the closure system of the present invention.

FIG. 10 shows a fourth preferred embodiment of the hermetic closure system 15' of the present invention, wherein the projections 10, 10' as described above are not present. In this case, the hermetic closure is guaranteed secondarily by means of the friction between a cover 1' and a ring 2 when these are engaged with each other, and mainly by virtue of the shaping of an end portion 25 of the cover 1', which works as a first lock element and is located at the upper portion of the wall 4 that is substantially opposed to the substantially semicylindrical end portion 14 of the first protuberance 6, and is substantially shaped as a circular crown, preferably presenting a slight inclination with respect to the main plane of the base of the cover 1'.

In this embodiment, the first projection or end portion 25 has a shape presenting a portion 20 in the form of a ring substantially adjacent to the wall 4 with a substantially semicylindrical cross-section and with a substantially longitudinal tear 22; and a substantially planar portion 21 that is substantially opposed to the semicyclindrical portion 20, the portion 21 being like a circular crown substantially tangential thereto.

When the cover 1' is fixed to the ring 2, the substantially semicylindrical portion 20 engages the end 8*a* of the wall 8. The end 8*a* comprises a second lock element or a second projection. However, the width of the opening provided by the tear 22 is substantially smaller than the diameter of the end 8*a*, bringing about a snap fitting that causes a characteristic noise informing the user that the cover 1' is correctly positioned onto the ring 2 and that the closure system 15' is guaranteeing hermetic closure of the package opening. This snap fitting provides a considerable area in which there is contact of the cover 1' with the ring 2, providing the hermetic closure and mechanical locking.

In both first, second, third, and fourth preferred embodiments of the hermetic closure system 15, 15' of the present invention, the peripheral tolerance of adjustment between the diameters of fitting between the cover 1, 1' and the ring 2 may be greater, since the fitting projections 10, 10', or the fitting between the portion 20 and the end 8*a*, provide total guarantee of hermetic closure. The hermetic closure system 15, 15' is able to tolerate increased internal pressure without inadvertently opening.

In this way, one can make use of virtually all the components mentioned in the specification, by virtue of this greater possible tolerance. In turn, greater tolerance means that one may use a manufacturing process with a greater standard deviation, with a consequent reduction in production cost of the hermetic closure system 15, 15'. And, by virtue of the projections 10, 10' and of the fitting between the portion 20 and the end 8*a*, the reduction in manufacture costs will not result in loss of quality of the system, since the hermetic closure continues to be effected with total reliability.

The hermetic closure system 15, 15' is particularly suitable for use in packing hazardous products, which, due to their physical and chemical characteristics, tend to cause a considerable increase in pressure inside the packing container, which could cause the product to come out with disastrous consequences.

Furthermore, the manufacturer may make relatively minor changes to the tools and stampers already used in the manufacture of similar components, to initiate the manufacture of this hermetic closure system 15, 15'.

The closure system of the present invention imparts to the packages an exceptional capacity of resisting internal pressures of the packed products, making them very safe and enabling them to meet the rules for the transport of hazardous products.

When used on packages in the form of metallic cans for packing liquid products, the closure system of the present invention resists extremely well various mechanical stresses, such as described below.

A package in the form of a metallic can provided with the closure system described here resists a minimum internal pressure of 100 KPa (kilopascal) for a duration of at least five minutes. This test is carried out by injecting compressed air into the closed package, reaching and maintaining the mentioned pressure for five minutes. Conventional packages do not stand this high pressure, even for a few moments, the cover detaching almost immediately.

In addition, the package in question also stands drops from a height of 80 centimeters when filled with water, in a vertical position, a horizontal position, or an inclined position in which it reaches the ground at about 45°, thus meeting the rules for resistance to dropping. The closure system can resist a dropping from up to 1.5 m (a meter and a half), without the cover detaching from the ring, even though, as a rule, packages do not resist this stress. In this way, the closure system of the present invention has a resistance to drops superior to that presented by the package itself, and so its utilization is extremely advantageous.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A hermetic closure system for a package having a first end defining an opening of the package, the hermetic closure system comprising:

a cover having a main face and a first protuberance that projects substantially perpendicular to a plane of the main face, the first protuberance extending about substantially an entire perimeter of the cover, the first protuberance having a first outer wall and a second inner wall defining a substantially U-shaped cross-section and the cover having a first lock element in the form of a projection located on the first wall and projecting radially outwardly away from an interior of the first protuberance; and a receiving ring formed at the first end of the package surrounding the opening, the receiving ring extending about an axis and having a second protuberance that projects substantially parallel to said axis and extends about substantially an entire perimeter of the ring, the second protuberance having a third outer wall and a fourth inner wall defining a substantially U-shaped cross-section and a second lock element in the form of a projection located on the third wall and projecting radially outwardly away from an interior of the second protuberance, wherein the substantially U-shaped profile of the second protuberance includes a generally semicylindrical portion joining an end of the third wall to an end of the fourth wall;

the second protuberance of the ring being configured to receive the first protuberance of the cover such that the first and second lock elements engage each other and prevent removal of the cover while so engaged.

2. The hermetic closure system of claim 1, wherein the substantially U-shaped profile of the first protuberance includes a generally semicylindrical portion joining an end of the first wall to an end of the second wall.

3. The hermetic closure system of claim 2, wherein the first and second walls are at a substantially constant distance from each other over substantially an entire height of the first protuberance.

4. The hermetic closure system of claim 1, wherein the third and fourth wall are at a substantially constant distance from each other over substantially an entire height of the second protuberance.

5. The hermetic closure system of claim 2, wherein the second protuberance receives the first protuberance such that the first and third walls are adjacent each other and the second and fourth walls are adjacent each other.

6. The hermetic closure system of claim 5, wherein there are two first lock elements respectively formed on the first and second walls and projecting away from each other, and two second lock elements respectively formed on the third and fourth walls and projecting away from each other for engaging the first lock elements.

7. A hermetic closure system for a package having a first end defining an opening of the package, the hermetic closure system comprising:

a cover having a central portion that lies substantially in a plane, and an outer peripheral portion joined to an outer edge of the central portion, the cover further comprising a generally ring-shaped first protuberance depending from the outer peripheral portion and extending substantially perpendicular to the plane of the central portion, the first protuberance having a generally U-shaped cross-section defined by a first outer wall and a second inner wall arranged substantially parallel to each other and an arcuate portion extending between lower ends of the walls, a first lock element being formed on the first wall of the first protuberance and projecting outward away from an interior of the U-shaped cross-section; and a receiving ring formed at the first end of the package surrounding the opening, the receiving ring extending about an axis and having a second protuberance that projects substantially parallel to said axis in a direction toward an opposite second end of the package and extends about substantially an entire perimeter of the ring, the second protuberance having a generally U-shaped cross-section defined by a third outer wall and a fourth inner wall arranged substantially parallel to each other and an arcuate portion extending between lower ends of the walls, a second lock element being formed on the third walls of the second protuberance and projecting outward away from an interior of the U-shaped cross-section;

wherein the second protuberance receives the first protuberance therein such that the first and second lock elements engage each other in a locking manner, and wherein each lock element comprises a first portion that projects substantially perpendicular to the wall of the respective protuberance and terminates at an outer end, and a second portion joined to the outer end of the first portion and extending obliquely down therefrom and joining with said wall of the respective protuberance.

8. The hermetic closure system of claim 7, wherein the second portion of each lock element has a curvature that is convex in a direction toward the interior of the U-shaped cross-section of the respective protuberance.

9. A hermetic closure system for a package having a first end defining an opening of the package, the hermetic closure system comprising:

a cover having a central portion that lies substantially in a plane, and an outer peripheral portion joined to an outer edge of the central portion, the cover further comprising a generally ring-shaped first protuberance depending from the outer peripheral portion and extending substantially perpendicular to the plane of the central portion, the first protuberance having a generally U-shaped cross-section defined by a first wall and a second wall arranged substantially parallel to each other and an arcuate portion extending between lower ends of the walls, a first lock element being formed on the first wall of the first protuberance and projecting outward away from an interior of the U-shaped cross-section, the first lock element comprising an upper portion that is parallel to the plane of the central portion of the cover and extends from the first wall radially away from the interior of the U-shaped cross-section of the first protuberance, and a lower portion joined to an outer end of the upper portion and extending obliquely down therefrom and joining with the first wall; and a receiving ring formed at the first end of the package surrounding the opening, the receiving ring extending about an axis and having a second protuberance that projects substantially parallel to said axis in a direction toward an opposite second end of the package and extends about substantially an entire perimeter of the ring, the second protuberance having a generally U-shaped cross-section defined by a third wall and a fourth wall arranged substantially parallel to each other and an arcuate portion extending between lower ends of the walls, a second lock element being formed on the third wall of the second protuberance and projecting outward away from an interior of the U-shaped cross-section, the second lock element comprising an upper portion that is perpendicular to the axis of the receiving ring and extends from the third wall radially away from the interior of the U-shaped cross-section of the second protuberance, and a lower portion joined to an outer end of the upper portion and extending obliquely down therefrom and joining with the third wall;

wherein the second protuberance receives the first protuberance therein such that the first and second lock elements engage each other, engagement of the first and second lock elements causing the upper portions thereof to contact each other and thereby prevent disengagement of the lock elements by purely axial force exerted on the cover.

10. The hermetic closure system of claim 9, wherein the first wall comprises an outer wall of the first protuberance and the first lock element projects radially outwardly from the first wall, and the third wall comprises an outer wall of the second protuberance and the second lock elements projects radially outwardly from the third wall.

11. The hermetic closure system of claim 9, wherein the first wall comprises an inner wall of the first protuberance and the first lock element projects radially inwardly from the first wall, and the third wall comprises an inner wall of the second protuberance and the second lock elements projects radially inwardly from the third wall.

* * * * *

UNITED STATES PATENT AND TRADEMARK OFFICE

CERTIFICATE OF CORRECTION

PATENT NO. : 6,719,166 B2
DATED : April 13, 2004
INVENTOR(S) : Ceolin et al.

It is certified that error appears in the above-identified patent and that said Letters Patent is hereby corrected as shown below:

Title page,
Item [56], References Cited, U.S. PATENT DOCUMENTS, insert the following:

-- 4,180,179 12/1979 Hoening et al. --.

Signed and Sealed this

Thirteenth Day of July, 2004

JON W. DUDAS
*Acting Director of the United States Patent and Trademark Office*